US009572441B1

(12) United States Patent
Naumovic

(10) Patent No.: US 9,572,441 B1
(45) Date of Patent: Feb. 21, 2017

(54) INERTIA/GRAVITY DISPENSING DEVICE

(71) Applicant: Nenad Naumovic, Boston, MA (US)

(72) Inventor: Nenad Naumovic, Boston, MA (US)

( * ) Notice: Subject to any disclaimer, the term of this patent is extended or adjusted under 35 U.S.C. 154(b) by 0 days.

(21) Appl. No.: 14/795,835

(22) Filed: Jul. 9, 2015

(51) Int. Cl.

| | |
|---|---|
| ***B65D 5/72*** | (2006.01) |
| ***B65D 25/40*** | (2006.01) |
| ***B65D 35/38*** | (2006.01) |
| ***A47G 19/24*** | (2006.01) |
| ***B65D 39/00*** | (2006.01) |
| ***B65D 21/02*** | (2006.01) |

(52) U.S. Cl.
CPC ..... *A47G 19/24* (2013.01); *B65D 21/0219* (2013.01); *B65D 39/00* (2013.01)

(58) Field of Classification Search
CPC ..... A47G 19/24; B65D 21/0219; B65D 39/00
USPC ..... 222/500, 477; 220/345.1, 345.4, 254.9
See application file for complete search history.

(56) References Cited

U.S. PATENT DOCUMENTS

| | | | | |
|---|---|---|---|---|
| 2,833,447 | A * | 5/1958 | Thiele | A47G 19/24 222/151 |
| 3,131,824 | A * | 5/1964 | Van Baarn | A47G 19/24 215/235 |
| 4,026,336 | A | 5/1977 | Spies | |
| 4,488,667 | A | 12/1984 | Swett et al. | |
| 4,545,508 | A | 10/1985 | Cribb, Jr. et al. | |
| 5,499,736 | A | 3/1996 | Kohl | |
| 6,116,469 | A | 9/2000 | Wallays et al. | |
| 6,364,169 | B1 | 4/2002 | Knickerbooker | |
| 8,251,256 | B2 | 8/2012 | Antal | |
| 8,701,941 | B2 | 4/2014 | Fuller et al. | |
| 8,851,338 | B2 | 10/2014 | Zarou | |
| 2003/0090036 | A1 | 5/2003 | Vogel | |
| 2006/0037978 | A1* | 2/2006 | Schuster | A47G 19/24 222/546 |
| 2006/0201974 | A1* | 9/2006 | Schuster | A47G 19/24 222/183 |

* cited by examiner

*Primary Examiner* — Patrick M Buechner
*Assistant Examiner* — Jeremy W Carroll
(74) *Attorney, Agent, or Firm* — Stan Collier, Esq

(57) ABSTRACT

A shaker device has a flow gate operated by gravity or by inertial force applied to the flow gate. The bottom of the gate has a plurality of spikes that fit within a plurality of openings in a cap. The flow gate may be a separate device to attach to a container or be attachable to a conventional shaker cap through which fluent material would fall. The flow gate slides upon one or more posts to prevent rotation thereon and misalignment. In a non-pouring position, the spikes prevent debris from entering in the shaker.

16 Claims, 7 Drawing Sheets

PRIOR ART

INERTIA/GRAVITY DISPENSING DEVICE

CROSS REFERENCES TO RELATED APPLICATIONS

NA

REFERENCE TO FEDERALLY SPONSORED RESEARCH OR DEVELOPMENT

NA

REFERENCE TO JOINT RESEARCH AGREEMENTS

NA

REFERENCE TO SEQUENCE LISTING

NA

BACKGROUND OF THE INVENTION

Field of the Invention

The present invention relates to utensils, and, in general, relates to kitchen utensils, and, in particular, relates to kitchen/dinning utensils that pour fluid or fluent materials therefrom.

Description of the Prior Art

Kitchen or dinning utensils are used for cooking food and/or in the preparation of food for eating such as the application of condiments thereon, for example.

For example, a conventional parmesan cheese shaker has a main body usually made of glass or plastic with a screw-on cap thereon with a plurality of holes therein sufficiently large to allow for the pouring or shaking of parmesan cheese chips therefrom. The holes are continually open and thus moisture, dirt, germs, and other matter can enter. The chips may become sticky and may clump on or about the openings to prevent proper pouring of the chips onto food.

Numerous examples of shakers, even stylized ones, are made by manufacturers such as Norpro, OneSource, Metalcraft, Royal Industries, Tablecraft, Tupperware, ShakeN-Pour, UsimplySeason, etc. The problem with open holes is addressed by one shaker having a cap with a rotatable cover with holes or slots that would align with holes or slots in the non-rotating section under the cap. When not in use, the cover is turned to prevent the open holes in the cap from being exposed. Other commercial shakers are available that are throw away and sold with condiments therein. One or more flip lids exposing multiple holes or one large opening are available. Various improvements or features are disclosed by issued patents or patent applications that address some of these problems:

US Patent Application 2006/0201974 discloses a shaker having a spring-biased flip top with prongs on an outer container for keeping the pour holes open in an inner container, the containers being separable. US Patent Application 2003/0090036 discloses a cap having self-closing flaps, two, to cover one section with holes and another section having a large opening. U.S. Pat. No. 8,851,338 discloses a controlled dispenser having a rotating ball 22 with a cavity 24 therein. A desired amount of material is placed in the cavity when turned upside down and then the ball rotated to retain that amount. The ball is further rotated to cause the cavity 24 to be exposed so that the material falls therefrom. U.S. Pat. No. 8,701,941 discloses a container having a clump decimator 155 located in a rotatable cap section 114. U.S. Pat. No. 8,251,256 discloses a container having a device for controlling the quantity of a granular material that exits from a bottom section. U.S. Pat. No. 6,116,469 discloses a wiper unit 3 with a sprinkler top 58. U.S. Pat. No. 5,499,736 discloses a cap member for a shaker. U.S. Pat. No. 4,545,508 discloses a flip-up lid having plugs 32 for insertion into openings for unblocking of material such as parmesan cheese. U.S. Pat. No. 4,488,667 discloses a removable cap 16 with cleaning plugs 60. FIG. 7. U.S. Pat. No. 4,026,336 discloses a spring controlled transfer means for moving condiments from a bulk storage container to a dispenser.

Accordingly, there is a need for device for easily insuring that openings in a utensil remain open as well as preventing entrance of foreign matter.

SUMMARY OF THE INVENTION

The use of food containers is a common method of cooking or applying fluent materials on food. Preventing the entrance of debris such as unwanted moisture, dust, dirt, that may contain or carry germs is a common desire. Various devices are used in cooking or food preparation to protect the food or applying fluent materials such as condiments to food.

A shaker cover device has a flow gate operated by a user through the use of force applied to the inertia gate and/or gravity. The bottom of the flow gate has a plurality of spikes/protrusions/rods that fit within a plurality of openings in a cover. The flow gate may be on a separate device or be attachable to a conventional shaker cap through which fluent or fluid materials would exit from. When the flow gate is inverted or inclined, gravity opens the flow gate or when the flow gate is forced to move it opens. The flow gate slides upon one or more posts to prevent rotation thereon and misalignment. In a non-pouring position, the spikes prevent debris from entering. When the user wants to place a condiment upon food, the user turns the shaker to incline or forceably moves the gate, the condiment falls from the openings. The inertia/gravity operated flow gate may be used on other types of utensils or devices such as a spaghetti cooker.

One object of the present invention is to provide a means for controlling the flow of fluids or fluent materials from utensils or containers of condiment or fluids.

It is another object of the present invention to provide a means for controlling the flow of fluids or fluent materials from utensils that is controlled by gravity when so properly oriented or forced to open by vigorous shaking.

It is a further object of the present invention to provide a cooking utensil with a liquid flow gate.

It is still a further object of the present invention to provide a cooking utensil with a fluent material flow gate.

It is yet a further object of the present invention to provide a cooking utensil with a flow gate that blocks a flow and also keeps clear apertures from which the flow comes.

It is yet a further object of the present invention to provide a inertia/gravity flow gate that is either integral or separately attachable to the utensil or container.

These and other objects, features, and advantages of the present invention will become more readily apparent from the attached drawings and the detailed description of the preferred embodiments, which follow.

BRIEF DESCRIPTION OF THE DRAWINGS

Like reference numerals refer to like parts throughout the several views of the drawings.

DETAILED DESCRIPTION OF THE PREFERRED EMBODIMENTS

The modern kitchen has numerous high tech features to assist in preparing the best meals possible. For example, the use of food containers such as metal pots is a common method of cooking and the use of condiment shakers for applying fluent materials on food provides a better tasting food for all. Preventing the entrance of debris such as unwanted moisture, dust, and dirt that may contain or carry germs is a common desire and is a common concern for chiefs either at home or in commercial restaurants. Various devices are used in cooking to protect the food or applying fluent materials such as condiments to food as will be described in detail herein.

In general, a shaker or other utensil has a device with a flow gate operated by a user through the use of force applied to the inertial gate and/or by gravity. A bottom of the flow gate has a plurality of spikes/protrusions/rods that fit within a plurality of openings in a cover. The flow gate may be on a separate device or be attachable to a conventional shaker cap through which fluent or fluid materials would exit from. When the flow gate is inverted or inclined sufficiently, gravity opens the flow gate or when the flow gate is forced to move it opens. The flow gate slides upon one or more posts or rails to prevent rotation thereon and misalignment between the spikes and protrusions. In a non-pouring position, the spikes prevent debris from entering into and through the holes. When the user wants to place a condiment upon food, the user turns the shaker to incline or forceably moves the flow gate or door, the condiment falls from the openings. The inertia/gravity operated flow gate may be used on other types of utensils or devices such as a spaghetti cooker.

Figure 1:
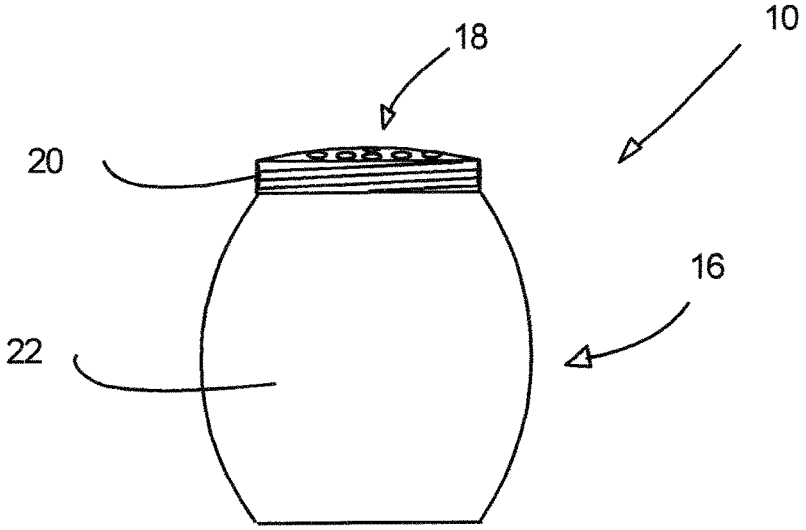
FIG. 1 is an illustration of two utensils, a shaker and a pot or kettle that may be used in the present invention.
Figure 1:
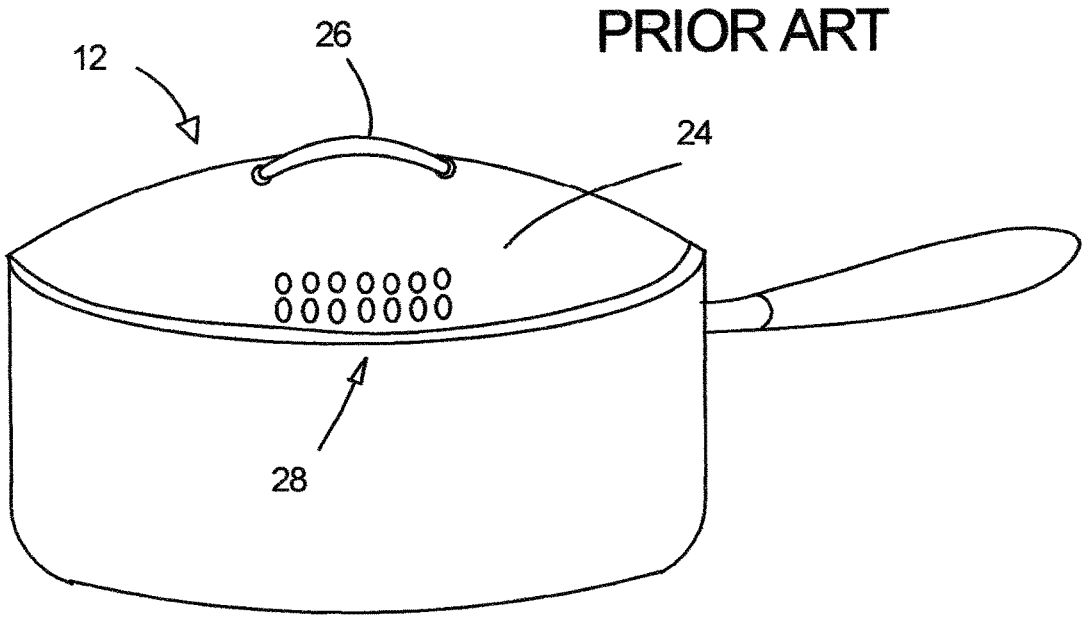

Referring to the Figures, FIG. 1 illustrates a conventional shaker 10 and a spaghetti cooking pot 12. Such shakers 10 may be of many different shapes 16, but all have openings 18 in a cap 20. The cap 20 screws onto a body 22. The condiments are typically placed into the body 22 by staff at the restaurant, and, in particular, parmesan cheese chips. The customer takes the shaker 10 in hand and turns and inclines it so that the chips fall from the openings 18, but do to non-use or other conditions, the chips may be blocking the openings 18, and thus the customer must more vigorously shake it or even attempt to clear the openings with forks or sharp knives or even tooth picks. This may lead to unsanitary conditions. Other types of conventional shakers are already filled when purchased in a store and are typically made of plastic with one or more flaps covering pouring holes in the top cap. These are less likely to have clogged pouring openings since the flaps can be closed.

Another utensil of concern is that of the cooking pot 12 as seen in FIG. 1. These pots 12 are normally metal and have a metal lid 24 with a handle 26 and drain holes or openings 28 in the lid 24. During cooking, very hot water may splash from the drain holes 28 or after cooking, debris may fall into the openings 28.

Figure 2A:
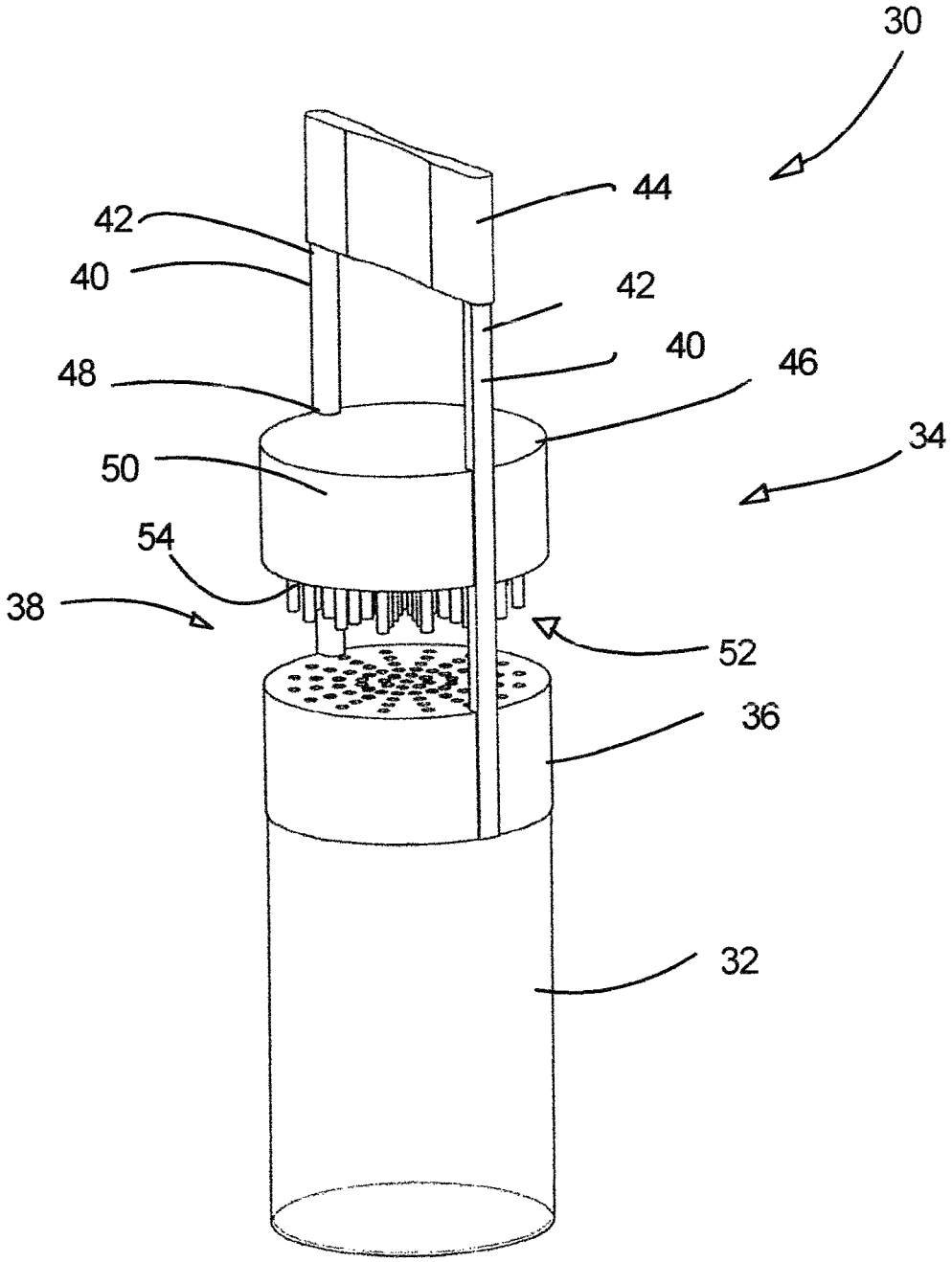
FIG. 2A is a perspective view of one embodiment of the present invention attached to a top of a container of condiment, for example.
Figure 2B:
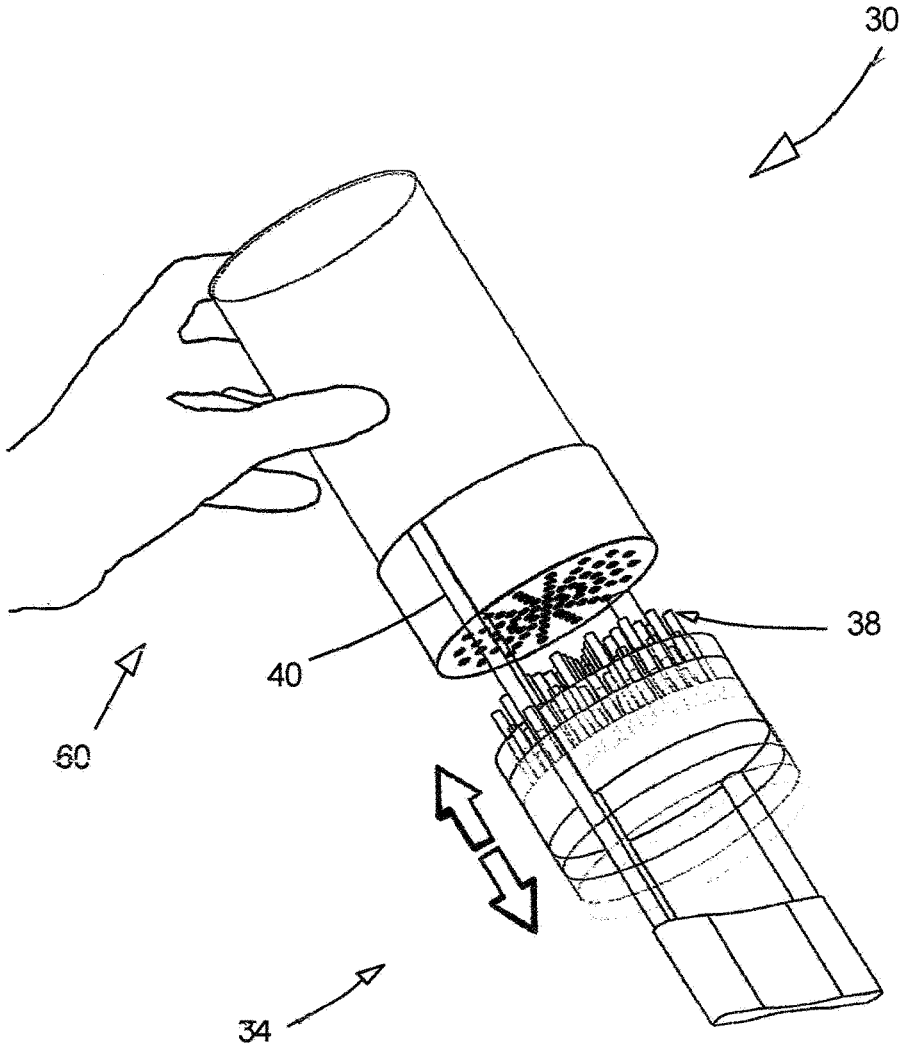
FIG. 2B is a perspective view of a user by hand applying force to move the flow gate by shaking.

Referring to FIG. 2A, an embodiment of a shaker 30 is shown in perspective view. A bottom cylindrical container 32 made of plastic may be of conventional design and have a threaded top section, not shown. A inertia/gravity dispensing device 34 is shown attached to the top threaded section of the container 32. A cap 36 may be pushed onto the top threaded section or screwed on and thus the device 34 may be placed on the full container 32 as purchased. The cap 36 has a plurality of openings 38. Attached fixedly to the cap 36 or integrally formed therewith are two shaped posts 40 or tracks or rails. The tops 42 of the posts 40 are fixedly attached to a bridge member 44. A flow gate 46 slides upon posts 40. The flow gate 46 may be cylindrical in shape with a pair of track guides 48 in the side 50. A plurality of spikes/rods/protrusions 52 are attached to a bottom 54 and are arranged in a similar pattern as the openings 38 so that they enter into the openings 38 when the flow gate 34 rests upon the cap 36. By the user's hand 60 as shown in FIG. 2B, the shaker 30 is inclined appropriately so that the flow gate 34 slides down the posts 40 to expose the openings 38 and to allow the removal thereof of fluent or fluid material. Further, the user's hand 60 may shake or vibrate the shaker 30 so that the inertia of the flow gate moves back and forth as shown in multiple overlaid images on the posts 40 to expose the openings 38 also so that the fluent or fluid material is removed through the openings 38.

Figure 3:
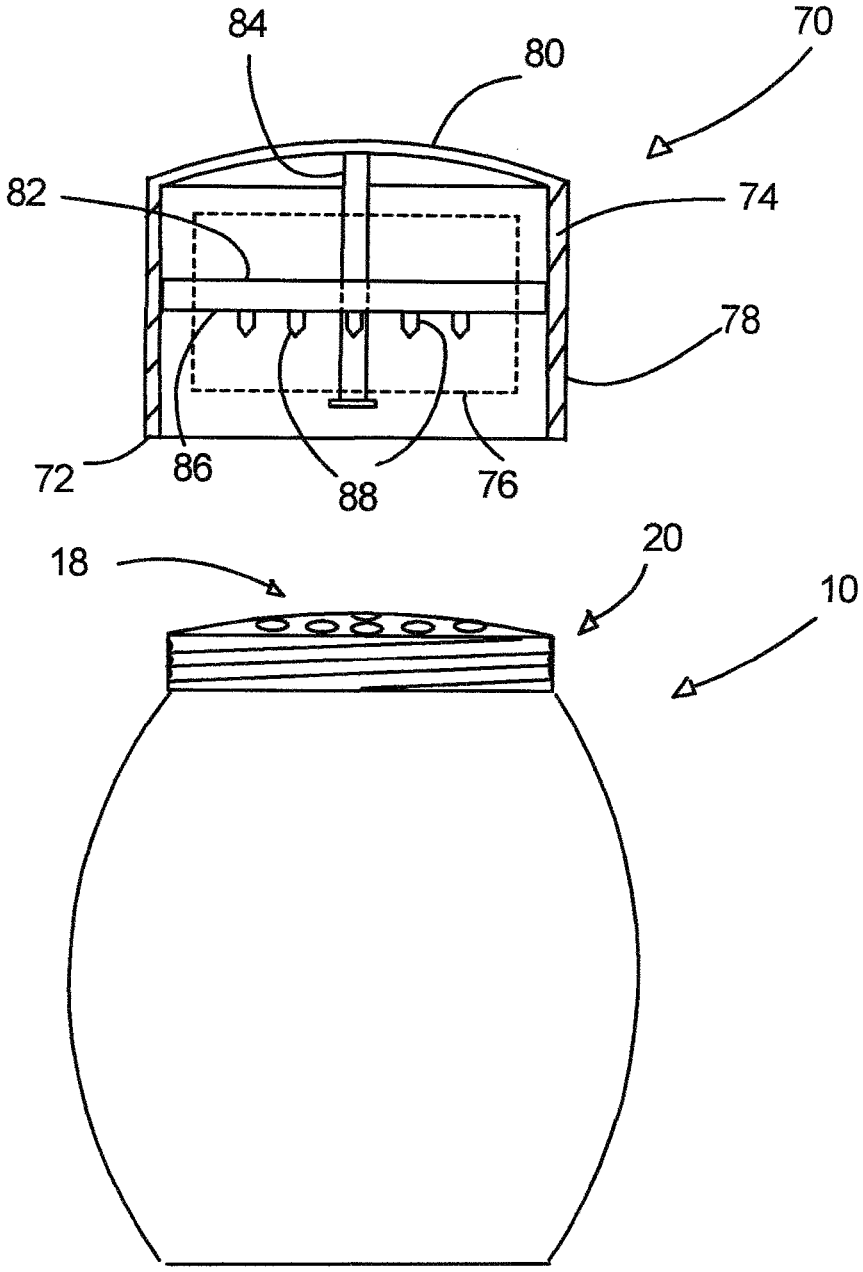
FIG. 3 is a cross sectional side view illustration of another embodiment of a flow gate device located above a shaker onto which it would be attached of the present invention.

Referring to FIG. 3 wherein another embodiment of the present invention is shown, a gravity operated flow gate device 70 may be attached to the cap 20 by press fit and as such would have no threads on a bottom 72 of a housing 74. The housing 74 may have a plurality of windows 76 in a side wall 78, one shown in outline, and even in a top wall 80 through which fluid or fluent materials may pass. A removable and translatable door 82 slides upon a center post 84 that may be rectangular in shape to prevent the rotation of the door 82 thereon. The door 82 has on a bottom side 86 with a plurality of spikes or plugs 88 that are aligned to the plurality of openings 18 on the cap 20 and fit within them when in the bottom most position, not shown. When so positioned, debris may not enter into the shaker 10. The door 42 is in a normally closed position upon said shaker 10 until the shaker 10 is tilted a predetermined amount to cause the translatable door 82 to slide to open the openings 18 to allow the flow of materials therefrom. Also, vigorous shaking may by inertia cause the door 82 to slide to expose the openings 18. Further the door 82 may be shaped to closely fit upon the cap 20 as determined by the brand of the shaker 10.

Although the post 84 is shown, other means may be used to allow the translatable door 82 to slide within the housing 74. Further, the housing 74 may have interior walls that are shaped to allow the translatable door 82 to slide therein on slots and tracks. Also the housing 74 may be oval shaped, rectangular shaped, and square shaped with the translatable door 82 of similar shape therein to move freely therein. The housing 74 may include the cap 20 integrally therein and be sold as a unit to restaurants, for example, see FIG. 4.

Figure 4:
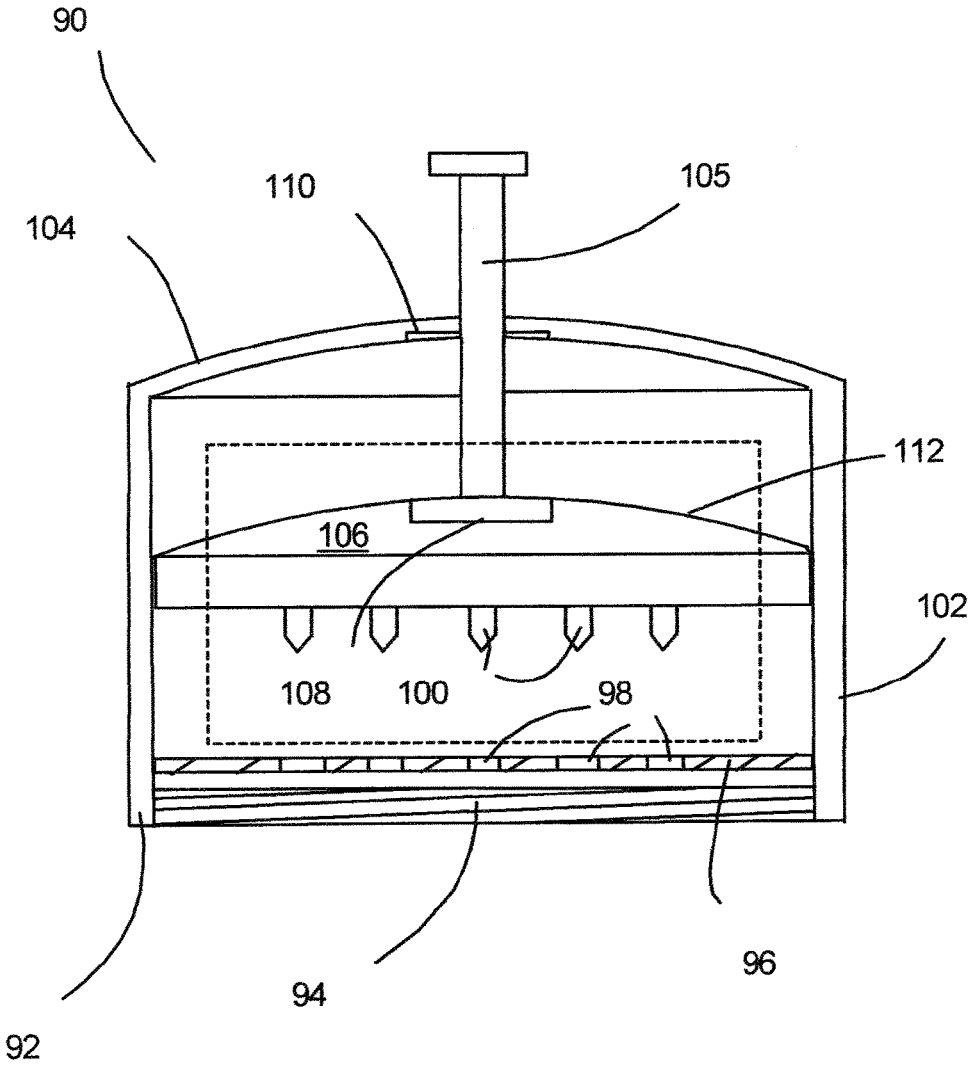
FIG. 4 is a cross sectional side view illustration of another embodiment of a flow gate device having a threaded bottom and other features of the present invention.

Referring to FIG. 4, another embodiment of a flow gate device 90 is shown. At the bottom 92 of a housing 102, the cap 20 has been incorporated into the bottom 92 and thus shows a threaded section 94 with a cap section 96 with openings 98 therein aligning with the spikes 100. Instead of sliding upon a post as in FIG. 3, a handle 105 slides within the housing 102 through a top wall 104 and is fixedly attached to the translatable door 106. Thus the user can move the translatable door 106 itself. Further, an additional weight 108 may be added to the door 106 to insure movement when tilted or shaken. The additional weight 108 may be a magnet also. In this situation, another oppositely designed magnet 110 may be located in the top wall 104 so that when the door 106 reaches the top travel, the two magnets 108 and 110 will engage and hold the door 106 open until pushed apart. As shown in FIG. 4, the top wall 104 and a top wall 112 of the door 106 are congruently formed so the magnets will be able to sufficiently come close to engage.

Figure 5:
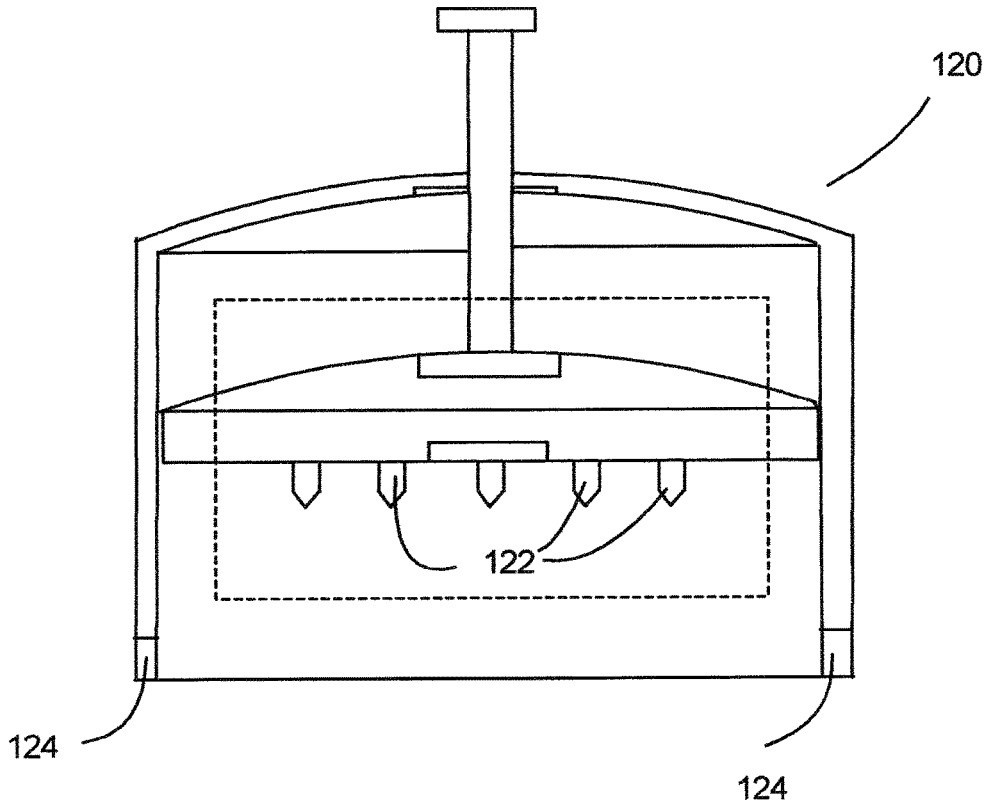
FIG. 5 is a cross sectional side view of another embodiment illustration of a flow gate for use on a metal pot such as used to cook spaghetti.

As shown in FIG. 5, a flow gate 120 is formed for use with the pot or kettle 12. The formation of the spikes 122 therein will conform to the manufacturer and design of the holes 28 in the cover or lid 24 so that the user can easily position the flow gate 120 thereon. Attachment of the flow gate 120 to the cover or lid 24 is by means of magnets 124 placed in the bottom of the housing. Conventionally, the kettle 12 may be used to cook spaghetti and the flow gate 120 to remove water therefrom as desired. Also a first magnet may be located in the bottom of the door and a second magnet in the housing wherein the utensil is composite of a magnetic material and the housing and/or door adhering to the utensil until released. The users may desire to have the openings to remain open until finished cooking and draining.

Figure 6:
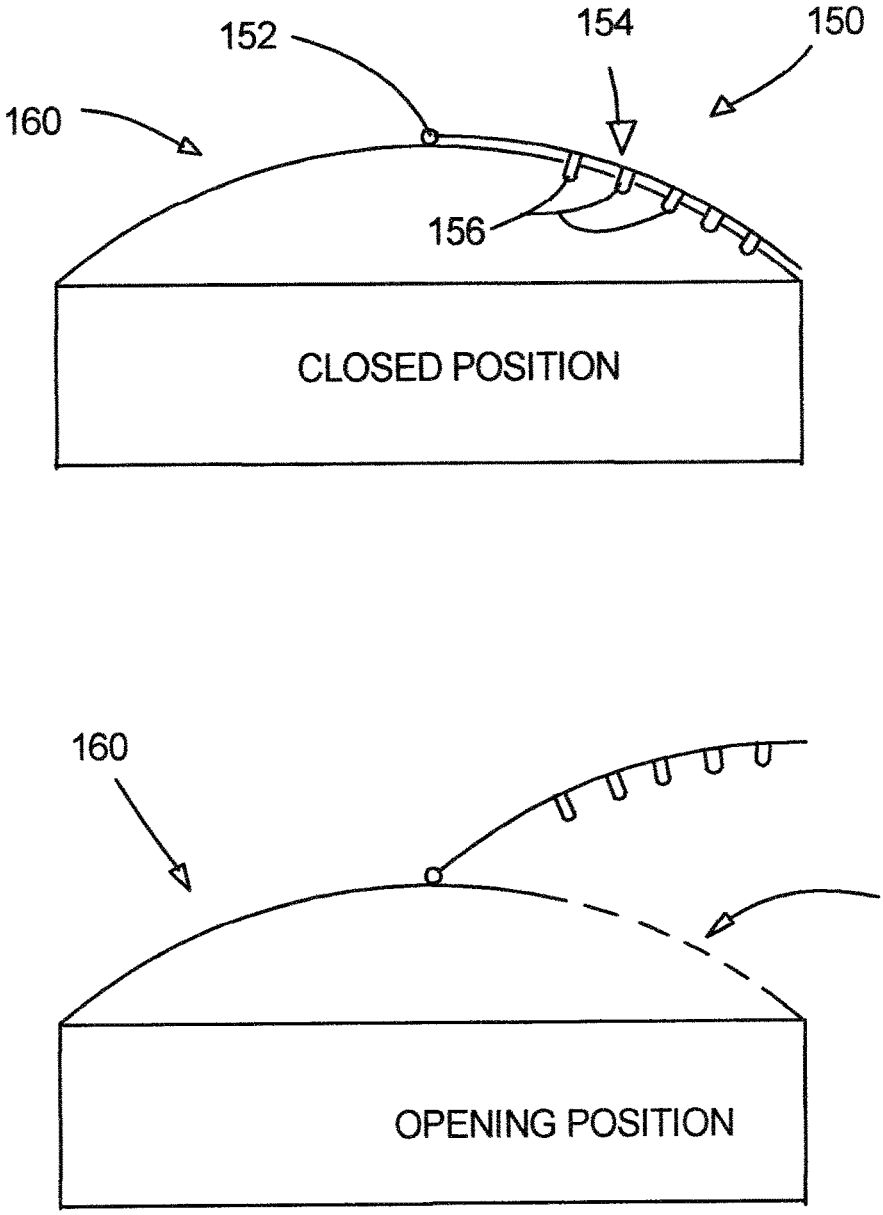
FIG. 6 is cross sectional side view of another embodiment of the present invention having a hinged flow gate/door on a cap.

Referring to FIG. 6, another embodiment of the inertia/gravity dispensing device 150 is shown, partially. Device 150 may be constructed of metal or plastic, and may be used on the convention shaker 10. A door/flow gate 154 is shown thereon with a hinge 152 connected operatively to a top of the conventional cap 160. A plurality of spikes 156 fit within the openings 158 in the cap 160. The door 154 moves freely upon the hinge 152 so that it opens when tilted or shaken.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A inertia/gravity dispensing device for a utensil, said inertia/gravity dispensing device having a flow gate comprising:

a housing, said housing being capable of mounting to a container, said container being capable of holding fluent or fluid materials for dispensing;

a door or flow gate, said housing have means for said door or flow gate to move freely thereon;

a plurality of spikes mounted on a bottom side of said door, each spike having a size sufficient to enter into an opening to prevent movement of materials through the opening;

wherein said inertia/gravity dispensing device is capable of being mounted to said utensil, said door is in a closed position upon said utensil until the utensil is tilted a predetermined amount or shaken to cause said door to open the openings to allow the flow of materials therefrom.

2. The inertia/gravity dispensing device as defined in claim 1, wherein said door is translatable on said housing.

3. The inertia/gravity dispensing device as defined in claim 2, wherein said housing includes a cap, said cap being able to fit upon a container for holding fluent or fluid materials.

4. The inertia/gravity dispensing device as defined in claim 3, wherein said door translates upon one or more posts, said one or more posts fixedly connected to said cap.

5. The inertia/gravity dispensing device as defined in claim 4, wherein a bridge is connected to tops of two posts.

6. The inertia/gravity dispensing device as defined in claim 2, further including additional weights in said door to aid in translation.

7. The inertia/gravity dispensing device as defined in claim 4, wherein said posts are rectangular in cross section to prevent rotation of said door thereon.

8. The inertia/gravity dispensing device as defined in claim 3, further including a threaded section in said cap to removably attach to a threaded container or utensil.

9. The inertia/gravity dispensing device as defined in claim 4, wherein said cap has a plurality of openings for fluent or fluid materials to flow therefrom when said door is open.

10. The inertia/gravity dispensing device as defined in claim 1, further including one or more magnets in said housing to removably attach said device to a metal utensil.

11. The inertia/gravity dispensing device as defined in claim 10, wherein the metal utensil is a cooking pot having a lid thereon with openings therein.

12. The inertia/gravity dispensing device as defined in claim 11, wherein said cooking pot is for spaghetti or the like pasta.

13. The inertia/gravity dispensing device as defined in claim 1, wherein the utensil is a shaker for dispensing condiments.

14. The inertia/gravity dispensing device as defined in claim 13, wherein the utensil is a shaker and said condiments is parmesan cheese.

15. The inertia/gravity dispensing device as defined in claim 1, wherein said housing has walls, said walls are shaped to allow said door to translate thereon.

16. The inertia/gravity dispensing device as defined in claim 1, further including a post attached to said door, said door being able to translate upon said post, and said post is fixedly attached to said housing.

* * * * *